US009825412B2

(12) United States Patent
Schlegel et al.

(10) Patent No.: US 9,825,412 B2
(45) Date of Patent: Nov. 21, 2017

(54) PROTECTIVE PLATE FOR A PLUG CONNECTOR SYSTEM

(71) Applicant: HARTING ELECTRIC GMBH & CO. KG, Espelkamp (DE)

(72) Inventors: Bernard Schlegel, Rahden (DE); Irina Loetkemann, Espelkamp (DE)

(73) Assignee: HARTING ELECTRIC GMBH & CO. KG (DE)

( * ) Notice: Subject to any disclaimer, the term of this patent is extended or adjusted under 35 U.S.C. 154(b) by 0 days.

(21) Appl. No.: 15/122,900

(22) PCT Filed: Nov. 19, 2014

(86) PCT No.: PCT/DE2014/100407
§ 371 (c)(1),
(2) Date: Aug. 31, 2016

(87) PCT Pub. No.: WO2015/154735
PCT Pub. Date: Oct. 15, 2015

(65) Prior Publication Data

US 2017/0077657 A1 Mar. 16, 2017

(30) Foreign Application Priority Data

Apr. 7, 2014 (DE) ..... 10 2014 104 902

(51) Int. Cl.
*H01R 13/60* (2006.01)
*H01R 13/73* (2006.01)
(Continued)

(52) U.S. Cl.
CPC ..... *H01R 13/73* (2013.01); *H01R 13/6591* (2013.01); *H01R 25/162* (2013.01)

(58) Field of Classification Search
CPC ..... H01R 13/73; H01R 13/514; H01R 25/006
(Continued)

(56) References Cited

U.S. PATENT DOCUMENTS 5,842,872 A * 12/1998 Hosler, Sr. ..... H01R 24/50 439/63
6,074,247 A * 6/2000 Hall ..... H01R 9/2408 361/728
(Continued)

FOREIGN PATENT DOCUMENTS

DE 202 14 287 2/2003 ..... H01R 13/73
EP 2 681 813 4/2015 ..... H01R 13/518
(Continued)

OTHER PUBLICATIONS

Written Opinion and International Preliminary Report on Patentability (English translation) issued in application No. PCT/DE2014/100407, dated Oct. 20, 2016 (10 pgs).
(Continued)

*Primary Examiner* — Jean F Duverne
(74) *Attorney, Agent, or Firm* — Hayes Soloway P.C.

(57) ABSTRACT

Provided is a protective plate for at least one plug connector attached to a mounting rail, said protective plate having a substantially U-shaped basic form with a closed main surface and side surfaces angled at approximately 90° to the main surface, wherein a securing region is angled at approximately 90° to the side surfaces, said securing region having at least one hole, and wherein an abutting region is angled at approximately 90° to the side surfaces, said securing region and the corresponding abutting region being positioned approximately perpendicular to one another. The system, formed by protective plate, a mounting rail and at least one plug connector, is optimally coordinated.

8 Claims, 2 Drawing Sheets

(51) Int. Cl.
*H01R 13/6591* (2011.01)
*H01R 25/16* (2006.01)

(58) Field of Classification Search
USPC ..... 439/532
See application file for complete search history.

(56) References Cited

U.S. PATENT DOCUMENTS 6,116,926 A * 9/2000 Ortega ..... H01R 13/6471 439/108
6,881,076 B2 * 4/2005 Baker ..... H04Q 1/146 333/260
7,329,148 B2 * 2/2008 Khemakhem ..... H01R 13/514 439/578
7,371,124 B2 * 5/2008 Khemakhem ..... H01P 1/045 439/668
7,699,617 B2 * 4/2010 Benham ..... H01R 23/688 439/63
8,876,548 B2 * 11/2014 Doorhy ..... H01R 25/006 174/53
2004/0057187 A1 3/2004 Kuboshima et al. ..... 361/118
2004/0171286 A1 9/2004 Baker ..... 439/76.1
2013/0260605 A1 * 10/2013 Kawabata ..... H01R 9/2608 439/532
2013/0337680 A1 12/2013 Schlegel ..... 439/532

FOREIGN PATENT DOCUMENTS

JP 2006-156273 6/2006 ..... H01R 13/46
JP 2010-170778 8/2010 ..... H01R 13/648

OTHER PUBLICATIONS

German Office Action issued in corresponding German Patent Appln. No. 10 2014 104 902.0 dated Oct. 14, 2014 (5 pgs).
International Search Report issued in corresponding PCT Patent Appln. No. PCT/DE2014/100407, dated Mar. 4, 2015, with English translation (5 pgs).
Written Opinion of the International Search Report issued in corresponding PCT Patent Appln. No. PCT/DE2014/100407, (6 pgs).

* cited by examiner

PROTECTIVE PLATE FOR A PLUG CONNECTOR SYSTEM

FIELD OF THE INVENTION

The invention relates to a protective plate for at least one plug connector secured to a mounting rail. The invention also relates to a system consisting of a protective plate, a mounting rail, and at least one plug connector.

Protective plates of this type cover plug connectors arranged in a row on a mounting rail and protect these, for example against damage during harsh everyday operation.

BACKGROUND OF THE INVENTION

Document EP 2 681 813 A1 presents high-power plugs which can be arranged in a row on a mounting rail. The plastic housing body of these high-power plugs can be damaged in harsh industry conditions, which can lead to a failure of the plug connector and potentially also to a safety risk.

SUMMARY OF THE INVENTION

The problem addressed by the invention is that of safely, economically, and effectively protecting plug connectors arranged in a row on a mounting rail.

The protective plate according to the invention is intended for at least one plug connector secured to a mounting rail. The protective plate has a substantially U-shaped base form, with a closed base area and side faces angled at approximately 90° thereto. Here, the term 'closed' means that the base area does not have any bores or the like arranged above the plug connector. The purpose of the protective plate is to cover the plug connector and to protect it, for example against mechanical damage.

The base area advantageously has recesses in the direction of each of the side faces. A securing region is angled at approximately 90° to the side faces. The securing region comprises at least one bore.

A contact region is angled at approximately 90° to the side faces. When protective plates are positioned oppositely, the contact regions of said plates are arranged oppositely, and potentially in contact with each other. It could also be said that the contact regions act as what are known as spacers or buffers.

The securing region and the associated contact region are positioned approximately at right angles to one another.

It has been found that the above-described geometry of the protective plate can be easily produced and offers effective protection for plug connectors arranged in a row on mounting rails. Plug connectors arranged in a row are also referred to hereinafter as plug connector systems.

The contact region has a fixing edge angled at approximately 90° or slightly more than 90°, which is oriented approximately parallel to the fastening region. This fixing edge engages in an undercut of the mounting rail and ensures that the protective plate does not fall off from the mounting rail, even if it is not secured in another way thereto, for example by screws.

The entire system, consisting of protective plate, mounting rail and at least one plug connector is optimally coordinated in terms of design. The plug connector is fixed on the mounting plate and covered by the protective plate.

The protective plate is advantageously fixed on the mounting rail by means of at least one double-ended stud bolt and an associated nut. The nut ideally also has a hexagon socket opening. This type of fixing is particularly space saving.

The double-ended stud bolt has a thread at both ends. In addition, the double-ended stud bolt has a collar centrally, which has a hexagon socket form upwardly. It can thus be mounted advantageously using a hex key.

Alternatively, the protective plate 1 can be fixed on the mounting rail by means of at least one clinch stud and an associated nut.

The above fixing alternatives are selected when two protective plates are arranged oppositely, as shown in FIG. 3.

BRIEF DESCRIPTION OF THE DRAWINGS

An exemplary embodiment of the invention is illustrated in the drawings and will be explained in greater detail hereinafter. In the drawings.

DETAILED DESCRIPTION OF THE INVENTION

The figures contain partly simplified, schematic illustrations. Identical reference signs are sometimes used for similar, but not necessarily identical elements. Different views of the same elements could be scaled differently.

Figure 1:
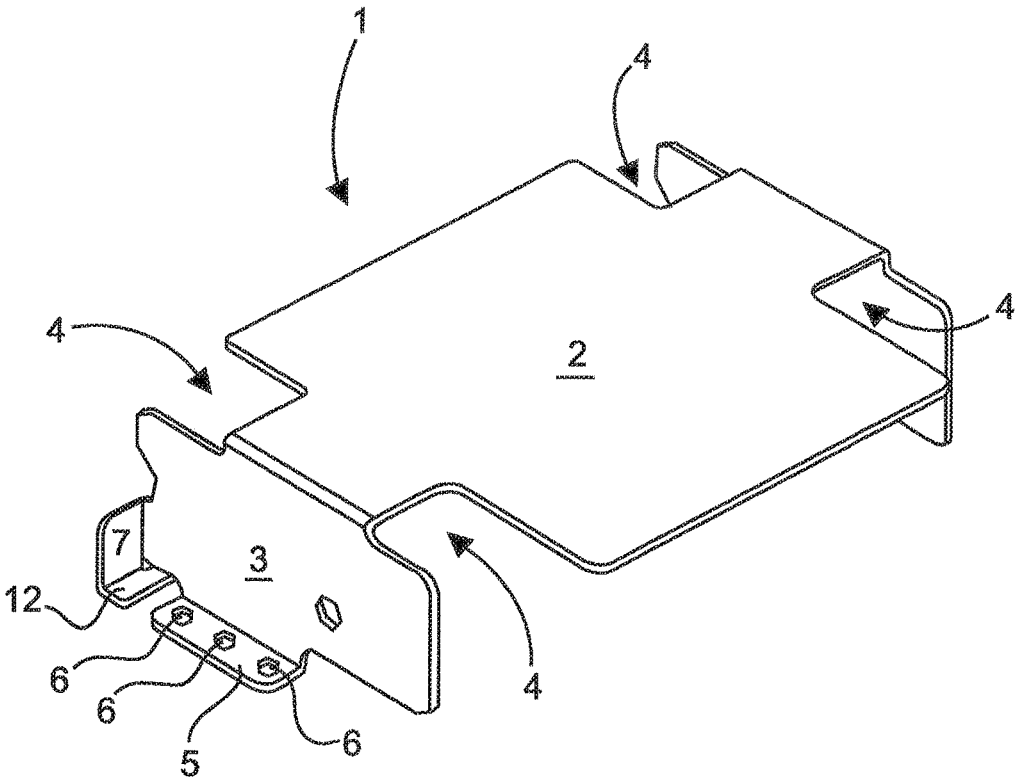
FIG. 1 shows a perspective illustration of the protective plate.
Figure 2:
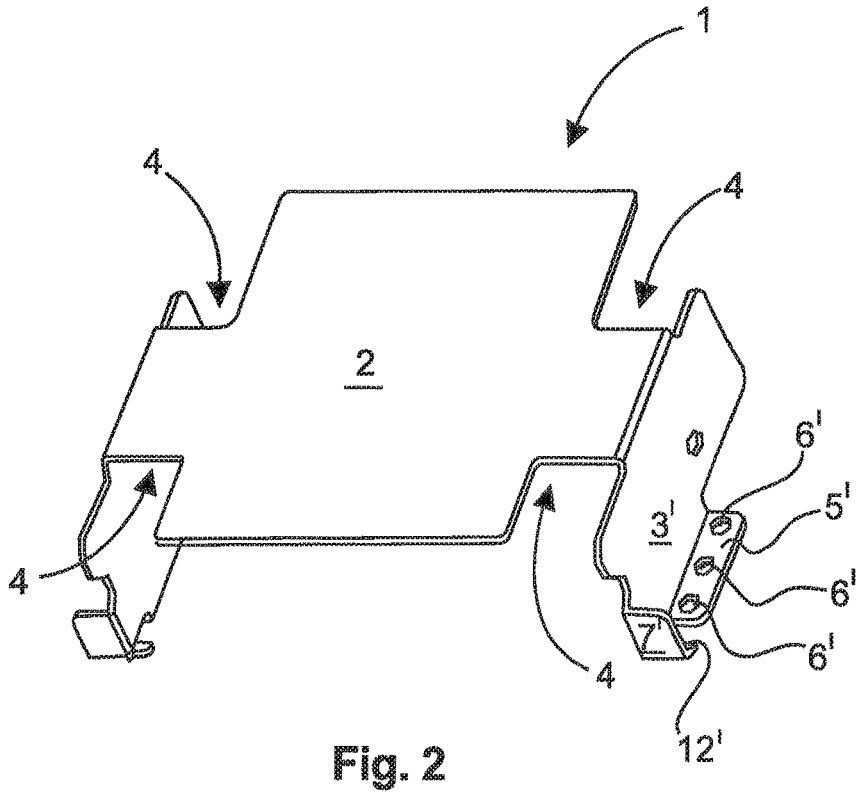
FIG. 2 shows a further perspective illustration of the protective plate.
Figure 3:
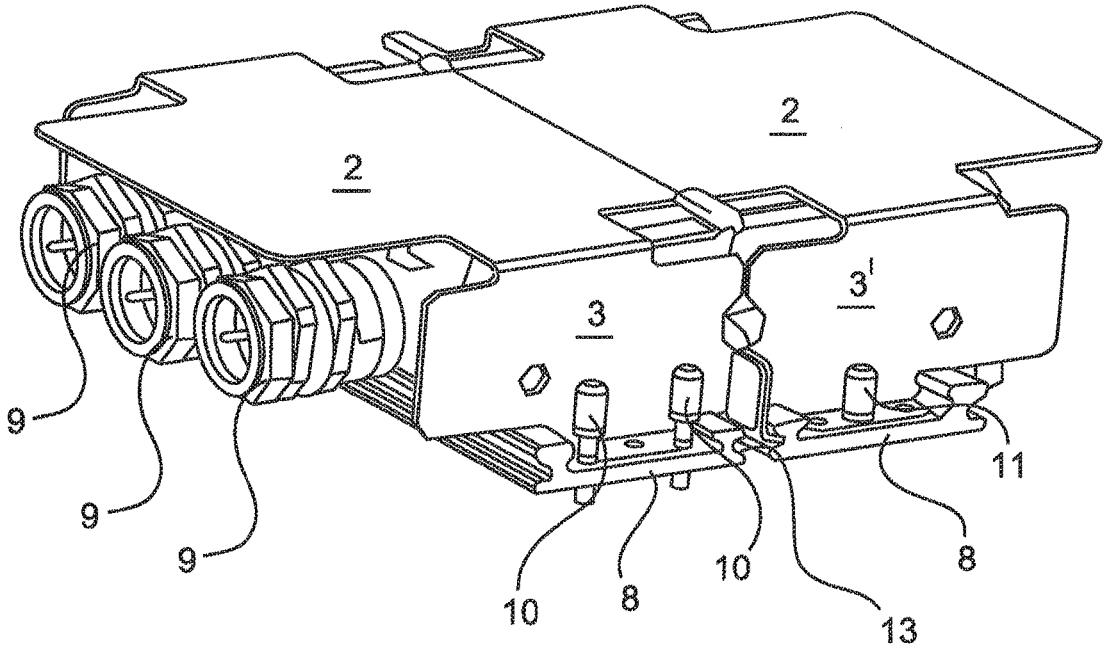
FIG. 3 shows two opposite systems, each consisting of protective plate, mounting rail, and plug connector.

FIGS. 1 and 2 show a protective plate according to the invention, in each case in a perspective illustration. The geometry illustrated here is folded from a steel sheet 1-2 millimeters thick. The steel sheet is processed by means of stamping and bending.

Side faces 3, 3' are bent at right angles from the main body 2 on both sides. Cutouts or recesses 4 are provided between the side faces 3, 3' and main body 2. Securing regions 5, 5' and contact regions bent at right angles thereto are in turn angled at right angles to the side faces 3, 3'.

A fixing edge 12, 12' is bent away from each of the contact regions 7, 7'. Here, the bending angle is slightly greater than 90°. This fixing edge 12, 12' engages in an undercut 13 of a mounting rail 8. The protective plate 1 is thus fixed on the mounting rail 8, even without a possible screw connection.

Bores 6, 6' are disposed in the securing region 5, 5'. The protective plate can be captively fixed on the mounting rail 8 via these bores 6, 6', for example with the aid of double-ended stud bolts 10 and/or clinch studs 11.

Protective Plate for a Plug Connector System

| List of reference signs | |
|---|---|
| 1 | protective plate |
| 2 | base area |
| 3, 3' | side face |
| 4 | recess |
| 5, 5' | securing region |
| 6, 6' | bore |
| 7, 7' | contact region |
| 8 | mounting rail |
| 9 | plug connector |
| 10 | double-ended stud |
| | pin |
| 11 | clinch stud |

-continued

| List of reference signs | |
|---|---|
| 12, 12' | fixing edge |
| 13 | undercut |
| 14 | |
| 15 | |
| 16 | |
| 17 | |
| 18 | |
| 19 | |
| 20 | |

The invention claimed is:

1. A plug connector system comprising a protective device, a mounting rail, and at least one plug connector, wherein the plug connector is fixed on the mounting plate and is covered by protective device which comprises an one piece protective plate having a substantially U-shaped basic form, with a closed main body area and side faces angled at approximately 90° thereto, said body main area having recesses provided between the side faces and the main body area, wherein a securing region is angled at approximately 90° to the side faces, wherein the securing region has at least one bore, wherein the contact region has an angled fixing edge which engages in an undercut of the mounting rail, and which is oriented approximately parallel to the securing region, wherein a contact region is angled at approximately 90° to the side faces, and wherein the securing region and the associated contact region are positioned approximately at right angles to one another.

2. The system as claimed in claim 1, wherein the one piece protective plate is fixed on the mounting rail by at least one double-ended stud bolt and an associated nut.

3. The system as claimed in claim 1, wherein the at least one double-ended stud bolt has a thread at both ends, and in that the double-ended stud bolt has a collar centrally, which has a hexagon socket form upwardly.

4. The system as claimed in claim 1, wherein the one piece protective plate is fixed on the mounting rail by at least one clinch stud and an associated nut.

5. The protective device as claimed in claim 1, wherein the main body area has recesses in the direction of each of the side faces.

6. The system as claimed in claim 2, wherein the at least one double-ended stud bolt has a thread at both ends, and in that the double-ended stud bolt has a collar centrally, which has a hexagon socket form upwardly.

7. The system as claimed in claim 3, wherein the one piece protective plate is fixed on the mounting rail by at least one clinch stud and an associated nut.

8. The plug connector system as claimed in claim 1, wherein the contact region has an angled fixing edge which is bent away from the contact region at a bending angle slightly greater than 90°, whereupon the protective device may be fixed on the mounting rail without need for a separate fastener.

* * * * *